US007153371B2

(12) United States Patent
Hansen et al.

(10) Patent No.: US 7,153,371 B2
(45) Date of Patent: Dec. 26, 2006

(54) EXTRACTION WITH CHEMICAL EXOTHERMIC REACTION HEATING

(75) Inventors: Eric J. Hansen, Ada, MI (US); Thomas K. Ankney, East Grand Rapids, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 415 days.

(21) Appl. No.: 10/065,480

(22) Filed: Oct. 22, 2002

(65) Prior Publication Data

US 2003/0075203 A1 Apr. 24, 2003

Related U.S. Application Data

(60) Provisional application No. 60/348,103, filed on Oct. 23, 2001.

(51) Int. Cl.
*B08B 7/04* (2006.01)

(52) U.S. Cl. ..... 134/10; 134/6; 134/26; 134/30; 134/34; 134/35; 134/36; 134/41; 15/320

(58) Field of Classification Search ..... 134/10, 134/6, 26, 30, 34, 35, 36, 42, 41; 15/320
See application file for complete search history.

(56) References Cited

U.S. PATENT DOCUMENTS

| | | | | |
|---|---|---|---|---|
| 3,357,923 | A * | 12/1967 | Wool et al. | 510/196 |
| 3,772,203 | A * | 11/1973 | Gray | 424/47 |
| 3,874,365 | A | 4/1975 | Pava | |
| 3,942,510 | A | 3/1976 | Garrett | |
| 4,425,251 | A | 1/1984 | Gancy | |
| 4,522,190 | A | 6/1985 | Kuhn et al. | |
| 4,793,323 | A | 12/1988 | Guida et al. | |
| 5,163,504 | A | 11/1992 | Resnick | |
| 5,275,156 | A * | 1/1994 | Milligan et al. | 607/114 |
| 5,341,541 | A * | 8/1994 | Sham | 15/320 |
| 5,390,659 | A | 2/1995 | Scaringe et al. | |
| 5,653,106 | A | 8/1997 | Katashiba et al. | |
| 5,979,164 | A | 11/1999 | Scudder et al. | |
| 6,029,651 | A * | 2/2000 | Dorney | 126/263.07 |
| 6,092,519 | A | 7/2000 | Fish et al. | |
| 6,125,498 | A | 10/2000 | Roberts et al. | |
| 6,131,237 | A | 10/2000 | Kasper et al. | |
| 6,167,586 | B1 | 1/2001 | Reed, Jr. et al. | |
| 2002/0040503 | A1 * | 4/2002 | Pace et al. | 8/115.51 |
| 2002/0112741 | A1 * | 8/2002 | Pieroni et al. | 134/6 |
| 2002/0129835 | A1 * | 9/2002 | Pieroni et al. | 134/6 |

FOREIGN PATENT DOCUMENTS

| | | |
|---|---|---|
| AU | 6362586 | 4/1987 |
| JP | 63061097 | 3/1988 |

* cited by examiner

*Primary Examiner*—Sharidan Carrillo
(74) *Attorney, Agent, or Firm*—McGarry Bair. PC

(57) ABSTRACT

An extraction cleaning machine comprising dispensing and recovery systems, the dispensing system including a system for generating heat with an exothermic reaction upon activation for heating the cleaning solution prior to dispensing of the cleaning solution onto a surface. The cleaning solution dispensing system comprises a cleaning solution reservoir to which the heat of the exothermic reaction can be added and a dispenser. The heat of the exothermic reaction can also be added in line to the cleaning solution between the cleaning solution reservoir and the dispenser. The recovery system includes a suction nozzle, a recovery tank and a vacuum source for drawing recovered liquid from the suction nozzle into the recovery tank. A method of cleaning a surface comprises the steps of heating a cleaning solution by an exothermic chemical reaction, applying the cleaning solution to the surface and recovering the cleaning solution from the surface.

7 Claims, 8 Drawing Sheets

EXTRACTION WITH CHEMICAL EXOTHERMIC REACTION HEATING

CROSS REFERENCE TO RELATED APPLICATIONS

This application claims the benefit of U.S. Provisional Application No. 60/348,103, filed Oct. 23, 2001.

BACKGROUND OF THE INVENTION

1. Field of the Invention

The invention relates to extraction cleaning. In one of its aspects, the invention relates to an extraction cleaner in which a cleaning solution is heated by an exothermic reaction. In another of its aspects, the invention relates to a method of cleaning a floor surface such as a carpet with a heated cleaning solution. In another of its aspects, the invention relates to heating a cleaning solution in an extraction cleaner by an exothermic reaction and applying the heated solution to a floor surface for cleaning.

2. Description of the Related Art

An extraction cleaning machine having a heater for dispensing a heated cleaning solution is disclosed in U.S. Pat. No. 6,131,237, incorporated herein by reference in its entirety.

U.S. Pat. No. 4,522,190 discloses a flexible electrochemical heater comprising a supercorroding metallic alloy powder dispersed throughout a porous polyethylene matrix. Upon the addition of a suitable electrolyte fluid, such as a sodium chloride solution, heat is rapidly and efficiently produced. The electrochemical heater element can be contained in a porous envelope through which fluid can pass for reacting with the alloy powder to generate heat while keeping the alloy powder contained within the envelope.

U.S. Pat. No. 5,163,504 discloses a package heating device in the form of a membrane holding a quantity of microscopic spheres containing a hydrous substance such as water or saline solution. The membrane further contains an anhydrous substance such as magnesium sulfate proximate to the spheres containing the water or saline solution. The anhydrous substance can also be contained in spheres. To activate the heating device, the spheres are mechanically broken to release the substances contained therein. The blending of the hydrous and anhydrous substances within the membrane generates an exothermic reaction releasing heat into the container associated with the heating device.

A container having an integral module for heating the contents is disclosed in U.S. Pat. No. 5,979,164. By way of example, the integral module functions as a cap for the container and comprises a sealed cavity holding the reactants for an exothermic reaction. The reactants are physically separated until a user wishes to initiate the exothermic reaction. In use, a liquid is placed in the container and the module is placed on the container in contact with the liquid. The reactants are then mixed within the sealed cavity to generate the exothermic reaction, the resultant heat being transferred from the module to the liquid in the container while the reactants remain fluidly isolated from the liquid.

U.S. Pat. No. 6,029,651 discloses a cup enclosing an aqueous sodium acetate solution and a metallic activator strip in a cavity formed between inner and outer walls of the cup. The aqueous sodium acetate solution is supercooled. The activator strip is a flexible metal strip accessible to a user through a flexible portion of the outer wall of the cup. When the user flexes the activator strip, it initiates a crystallization of the sodium acetate with an accompanying generation of heat, which can then be transferred to the contents of the cup. The sodium acetate is returned to the supercooled condition by heating above its melting point and air cooling. Flexing of the activator strip will again initiate crystallization. This cycle can be repeated indefinitely, making the cup reusable for heating fluids.

SUMMARY OF THE INVENTION

According to the invention, a method of cleaning a surface comprises the steps of heating a cleaning solution with an exothermic chemical reaction, applying the heated cleaning solution to the surface to clean the surface and recovering soiled cleaning solution from the surface. Preferably, the method includes the step of activating a chemical compound or combination of chemical compounds to undergo an exothermic chemical reaction.

In one embodiment, the exothermic chemical reaction comprises a phase change in a compound or composition that generates heat when transforming from one phase to another. In a preferred embodiment, the phase change is from a liquid to a solid, for example, a sodium acetate solution. In this embodiment, the activation step includes introducing a metal, such as aluminum or an aluminum alloy into the sodium acetate solution.

In another embodiment, the phase change is from one solid phase to another.

In a further embodiment, the exothermic chemical reaction comprises the step of combining two or more reagents that, when combined, undergo an exothermic reaction. For example, the two or more reagents can include a base and an acid that undergo an exothermic reaction when combined. In one embodiment, the acid is a mild acid that is added to the cleaning solution prior to the combining step. The mild acid lowers the pH of the cleaning solution to less than 7. In a preferred embodiment, the mild acid is a stearic acid and the stearic acid reduces the pH of the cleaning solution in the solution tank to the range of 4–5 prior to the combining step. In one method according to the invention, the base is triethanolamine and the triethanolamine is in a solution that has a pH in the range of 8–9. In this preferred embodiment, the reaction product of the weak acid and the weak base is a surfactant that becomes part of the cleaning solution.

The acids used in the invention can vary over a wide range. These acids include stearic acid, citric acid and phosphoric acids. Further, the bases can also vary over a wide range and include diethanolamine, triethanolamine, sodium hydroxide and potassium hydroxide. The acid and base can be added directly to the cleaning solution as in the case of a weak acid and weak base that form a surfactant, or can be added to a chamber in the cleaning solution tank that transfers the heat of reaction indirectly to the cleaning solution, as in the case where a strong base and/or strong acid is used to generate the exothermic heat. Thus, the heat of the exothermic heating can be transferred indirectly to the cleaning solution through a heat exchanger either in the cleaning solution tank or in line between the cleaning solution tank and a dispenser for applying the heated cleaning solution to the floor.

In another embodiment of the invention, the two or more reagents are aluminum and a reactant caustic compound. In yet another embodiment of the invention, the two or more reagents include a supercorroding metal alloy.

In one embodiment, the cleaning solution dispensing system has a cleaning solution tank with an inner wall and an outer wall. The inner wall defines a chamber for holding a cleaning solution and the inner wall and the outer wall define a heating cavity between them. The exothermic heating system is positioned in the cavity for generating heat for transfer to the cleaning solution contained in the chamber. In this embodiment, the exothermic heating system can be an aqueous sodium acetate solution that gives off heat energy during crystallization from a supercooled liquid state. Crystallization is initiated by mechanical deformation of a portion of the solution in a supercooled liquid state.

In this embodiment of the invention, the cleaning solution tank can have electrodes for introducing an electrical charge to separate by electrolysis the reagents in the solution tank cavity before use of the extractor. Upon removal of the electrical charge, the reagents then react exothermically to generate heat for the cleaning solution in the tank.

In another embodiment, the cleaning solution dispensing system has a cleaning solution tank that defines a chamber for holding a cleaning solution. The exothermic heating system comprises a compound or combination of compounds which, when introduced directly into the cleaning solution tank chamber, will react with the cleaning solution and/or with each other to generate an exothermic reaction to heat the cleaning solution. In this embodiment, the exothermic heating system can be two or more reagents that, when combined, undergo an exothermic reaction. For example, the reagents can be a base and an acid that undergo an exothermic reaction when combined. Alternatively, the exothermic heating system is a supercorroding metal alloy.

The heat added to the solution by the exothermic heating system can be used in lieu of, or in addition to, an electrical or other heating mechanism in the extractor. For example the exothermic heating system can be used with an in-line or in-tank heater.

DETAILED DESCRIPTION

Figure 1:
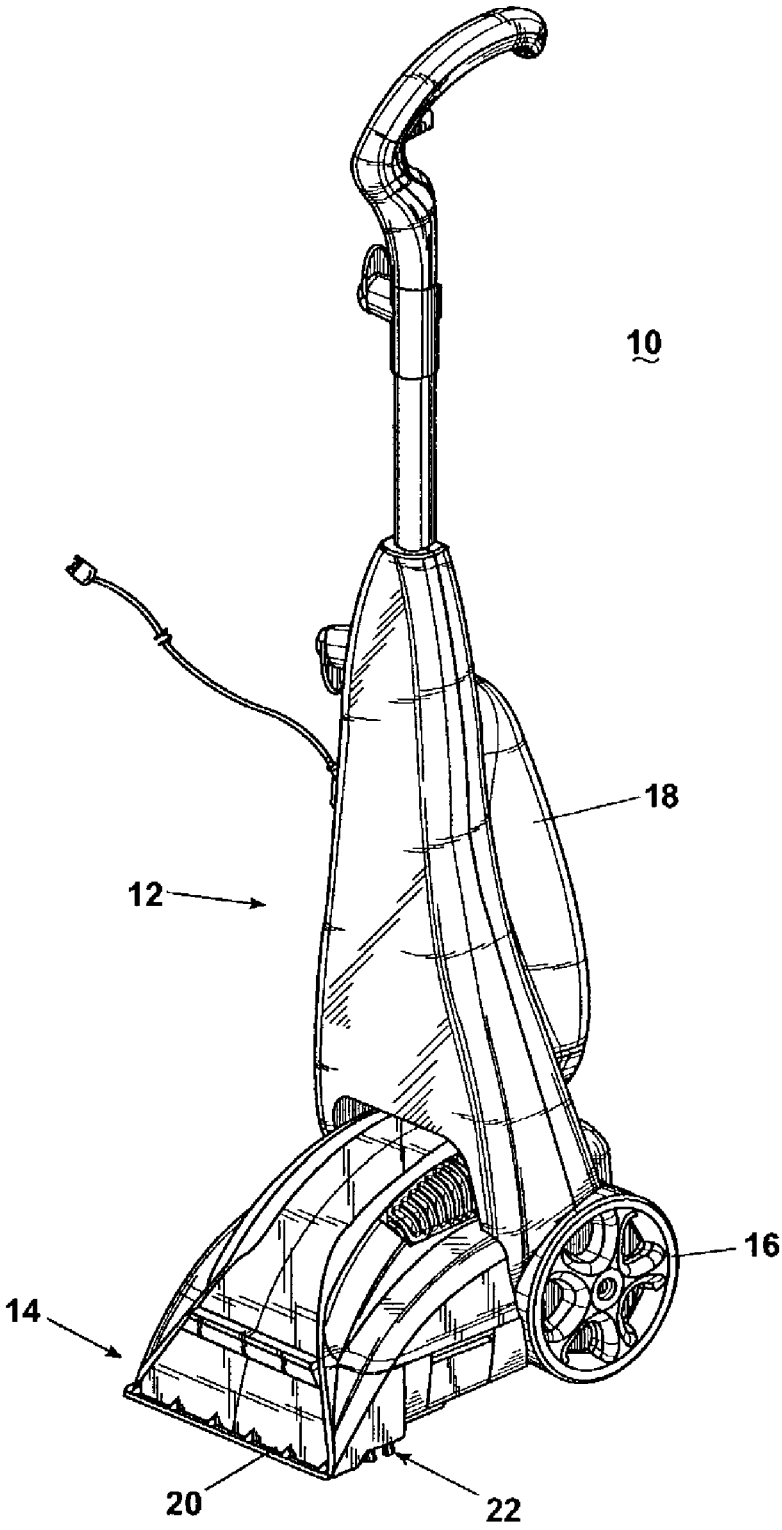
FIG. 1 is a perspective view of an extraction cleaner according to the invention.

Referring to FIG. 1, an upright extraction cleaner 10 according to the invention comprises an upright handle 12 and a base 14. A clean solution tank 18 is carried by the upright handle 12. The base 14 is partially supported by wheels 16 and by suction nozzle 20. A fluid dispensing nozzle 22 is disposed on an underside of the base 14 to the rear of the suction nozzle 20 for dispensing a cleaning solution on a surface being cleaned.

Extraction cleaning using exothermic chemical heat according to the invention is not limited to the upright extraction cleaner 10 of FIG. 1, but also includes application in a canister-type or portable hand-held extraction cleaner. The extraction cleaner according to the invention includes a fluid dispensing system for applying a cleaning solution to a surface being cleaned, and further includes a fluid recovery system for removing soiled solution from the surface being cleaned. These systems are described in further detail in U.S. Pat. Nos. 6,125,498, 6,131,237 and 6,167,586 and U.S. patent application Ser. No. 09/755,724, filed Jan. 5, 2001, all of which are commonly owned with this application and are incorporated herein by reference in their entirety.

Figure 2:
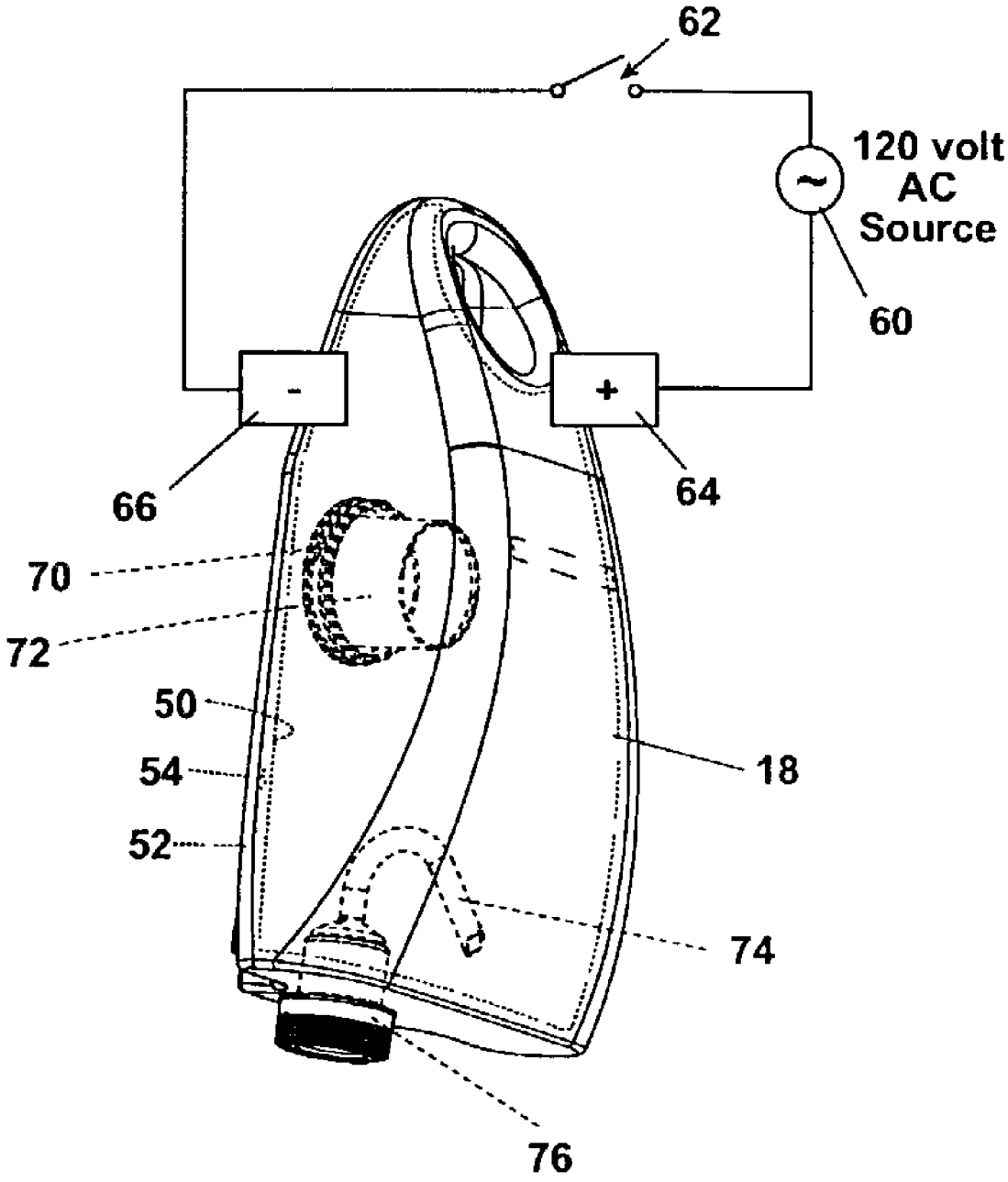
FIG. 2 is a perspective view of a clean solution tank of the extraction cleaner of FIG. 1 illustrating one embodiment of the invention.
Figure 3:
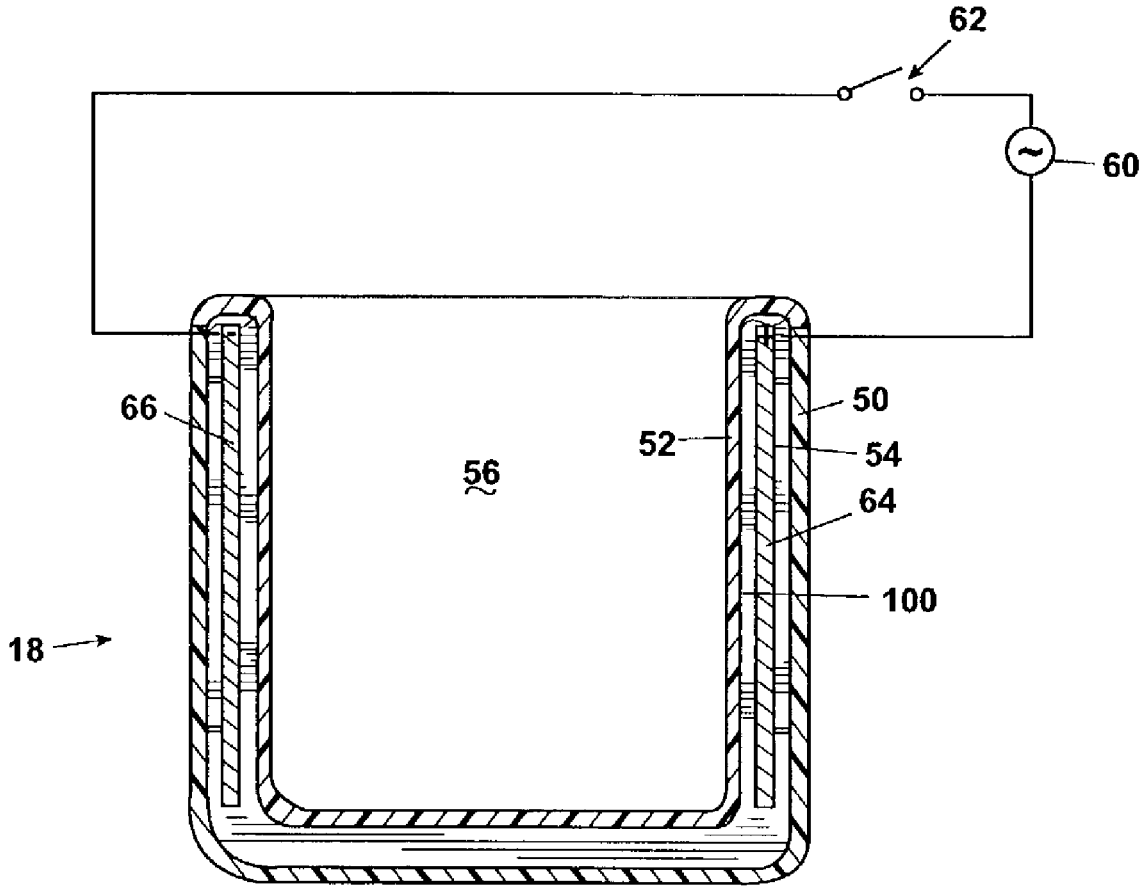
FIG. 3 is a schematic cross-sectional view of the clean solution tank illustrated in FIG. 2.

Referring now to FIGS. 2–3, clean solution tank 18 comprises a double-walled receptacle formed by an inner wall 52 and an outer wall 50 defining a cavity 54 therebetween. The inner wall 52 defines a chamber 56 for holding a cleaning solution. Chamber 56 is filled with cleaning solution through fill opening 70, which is selectively sealed with cap 72. The cavity 54 defined between the inner wall 52 and the outer wall 50 contains a reactant fluid mixture 100. Upon the blending of the reactants contained in the fluid mixture 100 within the cavity 54, an exothermic reaction ensues. The heat generated by the exothermic reaction is then transferred through the inner wall 52 to a cleaning solution held within the chamber 56 for dispensing by the extraction cleaner. The cleaning solution is dispensed through tube 74 and valve assembly 76 or the solution dispensing system of the extraction cleaner. In one embodiment, the outer wall 50 of the receptacle is thermally insulated to preclude the loss of heat to the atmosphere and to contain the heat generated by the exothermic reaction in the solution within chamber 56 of the clean solution tank. The double wall receptacle forms a heat exchanger between the cavity 54 and the chamber 56 for transfer of the exothermic hear of reaction from the cavity 54 to the chamber 56.

The reactants contained within the cavity 54 between the inner and outer walls 50, 52 are combined to initiate the exothermic reaction. The reactants are capable of separation by the application of opposing electrical charges 60 applied to an anode and cathode 64, 66 mounted within the cavity 54 for emersion in the fluid 100. The anode and the cathode 64, 66 are positioned remotely from one another to maximize the polarization of the reactant fluid 100 and resulting separation of the reactive components. Well-known heat pumps use similar systems in which heat energy is stored in separated components for release of heat energy upon combining of components.

The reactant fluid 100 can be rejuvenated by the application of the electrical potential between the anode 64 and cathode 66 after each use of the solution tank 18, or during pauses in use of the extraction cleaner. An advantage of the exothermic heating is found in the addition of thermal energy to the cleaning solution without the need to expend additional electrical energy during the cleaning process. The available electrical capacity can then be used in other components of the extraction cleaner, such as an agitation brush, suction source, or resistance heater. A resistance heater, such as an in-line heater or an in-tank heater, can be more effective in heating the cleaning solution to a more optimum temperature when used in combination with exothermic heating of the invention.

Figure 4:
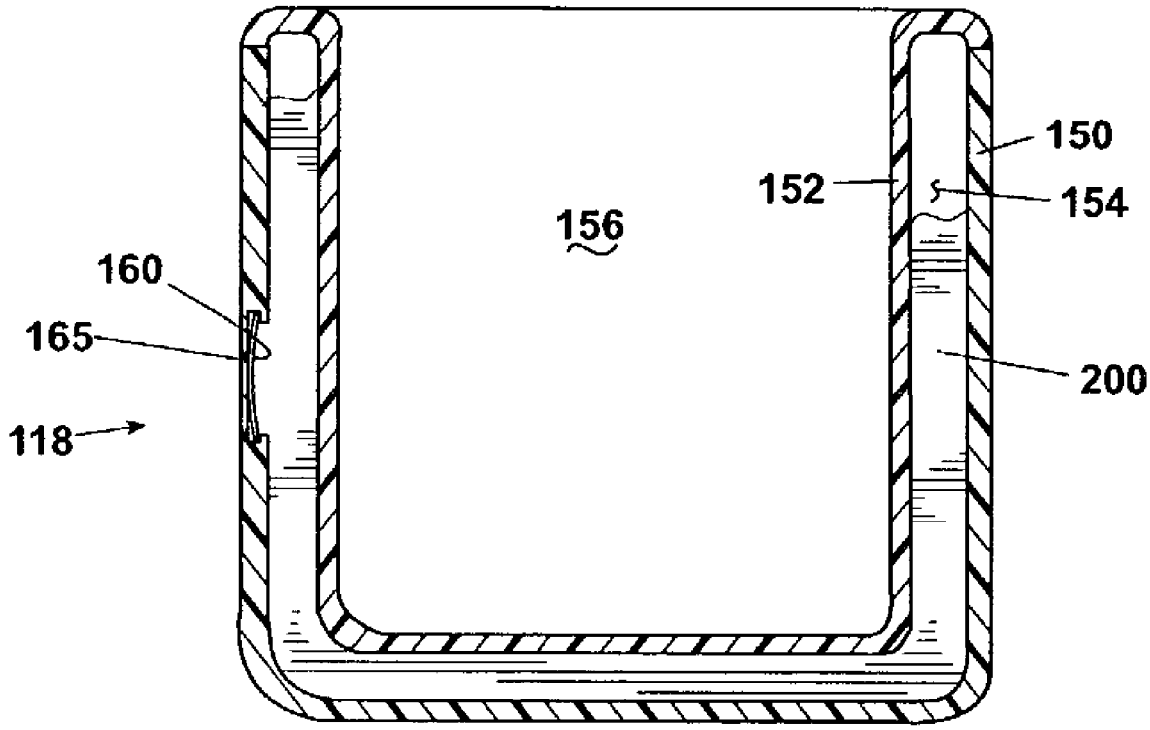
FIG. 4 is a cross-sectional view of a clean solution tank according to a second embodiment of the invention.

In a further embodiment of the invention shown in FIG. 4, the cavity 154 between the inner wall 152 and outer wall 150 of the solution tank 118 contains, by way of example, an aqueous sodium acetate solution 200 and a metallic activation strip 160. The activation strip 160, preferably formed of aluminum, is positioned adjacent a flexible portion 165 of outer wall 150. A user flexes the activation strip to initiate crystallization of the sodium acetate, which is an exothermic reaction. Such a system is disclosed in U.S. Pat. No. 6,029,651, which is incorporated herein by reference. As the sodium acetate crystallizes exothermically, it transfers heat to the cleaning solution within the solution tank 118. After each use, the sodium acetate must be returned to its liquid state. This is commonly accomplished by placing the tank 118 in boiling water or heating in an oven. As the sodium acetate cools, it remains in a supercooled liquid state, storing the energy that it will later release during crystallization. The solution tank 118 is thus reusable.

Figure 5:
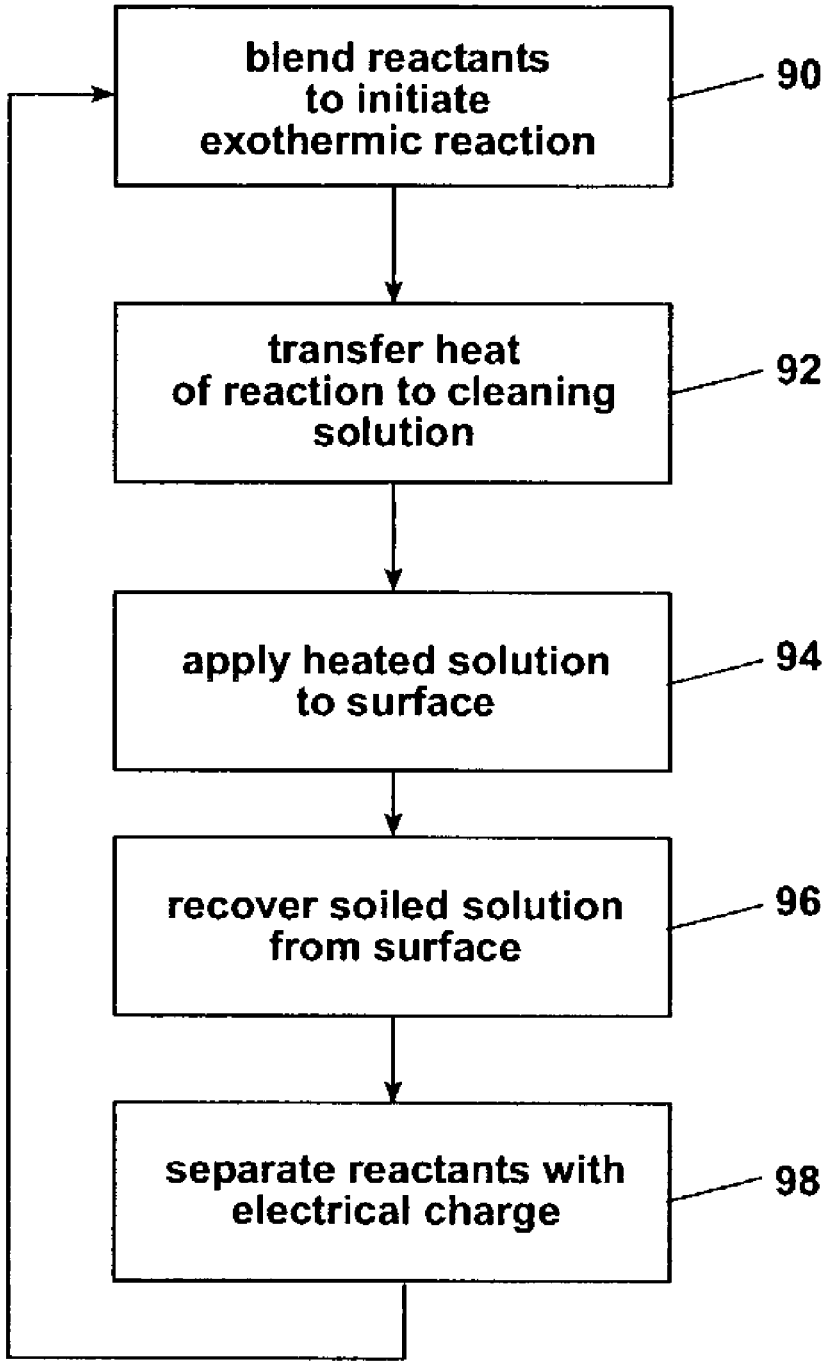
FIG. 5 is a flowchart of an exothermic reaction heating cycle according to the embodiment of FIGS. 2 and 3.
Figure 6:
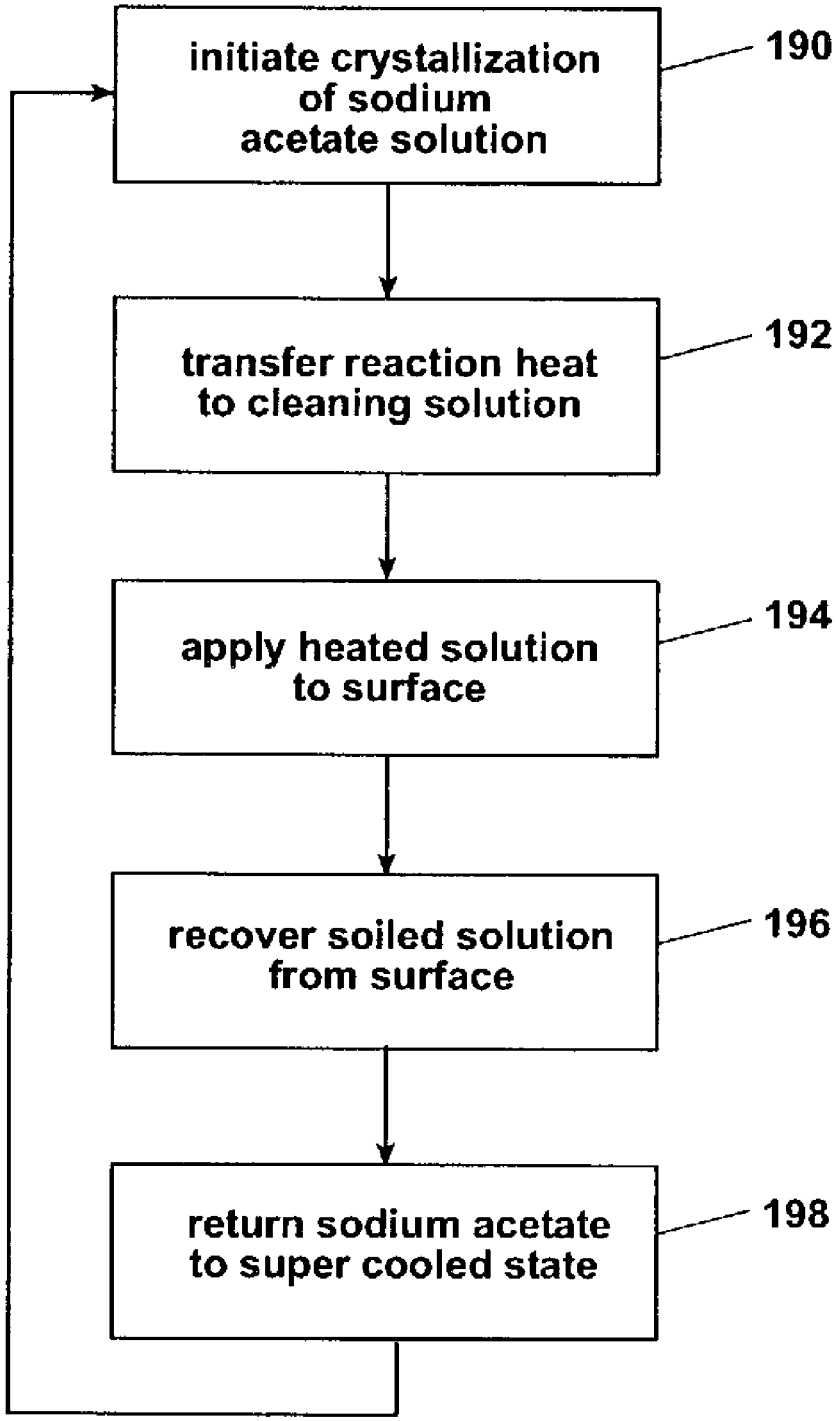
FIG. 6 is a flowchart of an exothermic reaction heating cycle according to the embodiment of FIG. 4.

FIGS. 5–6 are flow charts describing the cycle of use of the embodiments depicted in FIGS. 2–4. Referring first to FIG. 5, the reactants are blended in step 90 to initiate an exothermic reaction. The reactants then transfer heat in step 92 to the cleaning solution contained within the solution tank. The heated cleaning solution is then dispensed by the extraction cleaner in step 94. The soiled solution is then recovered from the surface being cleaned in step 96. The reactants are then returned to their separated state in step 98 by the application of an electrical charge, ready for blending the next time the exothermic reaction is needed to heat a cleaning solution. Alternatively, the spent exothermic solution can be removed from the cavity 54 and discarded and new reactants can be added to the cavity 54 when further heating of the cleaning solution is desired. Alternatively, the spent exothermic solution can be removed from the cavity 54 and separated into its components in an operation outside of the cavity 54. The separated components can then be returned to the cavity 54 when further heating of the cleaning solution is desired.

Referring now to FIG. 6, the process is begun by filling the tank 56 with water or detergent cleaning solution. The first step in the cleaning process is initiating crystallization in step 190 of the sodium acetate solution. The crystallization process is an exothermic reaction, the heat of which is transferred in step 192 to the cleaning solution. The heated cleaning solution is then applied to the surface being cleaned in step 194. The soiled solution is then recovered in step 196. The crystallized sodium acetate is then returned to its supercooled liquid solution form in step 196 by heating above its melting point and air cooling. It can thus be used repeatedly for heating by exothermic reaction.

Figure 7:
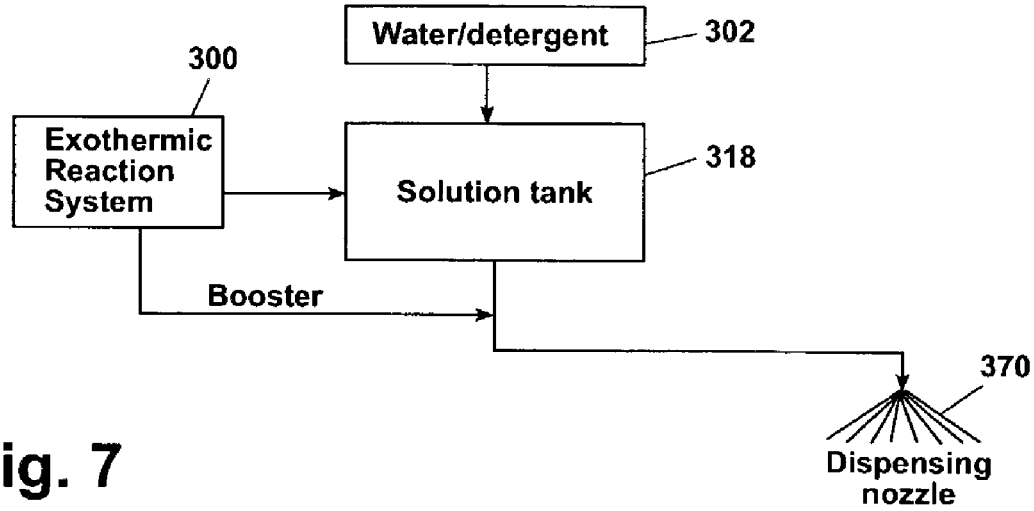
FIG. 7 is a schematic representation of an exothermic reaction heating process according to a third embodiment of the invention.

In a third embodiment of the invention depicted in FIG. 7, a clean solution tank 318 in an extraction cleaner is filled with a cleaning solution 302. The cleaning solution can be at room temperature, or preferably at an elevated temperature. An exothermic heating system 300 according to the invention is then added to the cleaning solution 302 in the clean solution tank 318. The exothermic heating system 300 reacts exothermically within the cleaning solution 302 to further elevate the temperature of the cleaning solution 302. The heated cleaning solution is thus ready for dispensing from a dispensing nozzle 370 onto a surface to be cleaned, the elevated temperature of the solution acting to more effectively remove soil from a surface.

Various combinations of additives that react exothermically are anticipated for use in this and other embodiments of the invention. One example is the addition of a mild acid, such as stearic acid, to the cleaning solution in the solution tank to lower the pH of the cleaning solution to less than 7, and preferably to the range of 4–5. The exothermic reaction is initiated by then adding a mild caustic such as triethanolamine, with a pH greater than 7, and preferably in the range of 8–9. This combination has the further beneficial effect of producing a surfactant that becomes part of the cleaning solution. Other acid/base combinations are equally anticipated for use, including citric or phosphoric acids, and diethanolamine, sodium hydroxide or potassium hydroxide. More aggressive exothermic reactions are available by the addition of metallic exothermic heating systems such as aluminum, which react with the caustic compounds. All of these compounds can be used either within the cleaning solution or, in some cases, in the cavity 54 of the embodiment of FIG. 3.

In the embodiment shown in FIG. 7, additional exothermic heating system 300 in the form of a booster can be added to the cleaning solution as it is being dispensed so that the ongoing exothermic reaction further elevates the temperature of the applied cleaning solution as it is being dispensed onto the carpet or floor surface. The booster can be added directly to the cleaning solution or can be passed through a heat exchanger to indirectly transfer heat from the booster to the cleaning solution in line.

In the embodiment of FIG. 7, the exothermic heating system added to the cleaning solution can be configured or selected to behave in a time-release fashion. The exothermic reaction thereby takes place over an extended period of time and maintains the cleaning solution at an elevated temperature for a longer period of time.

Figure 8:
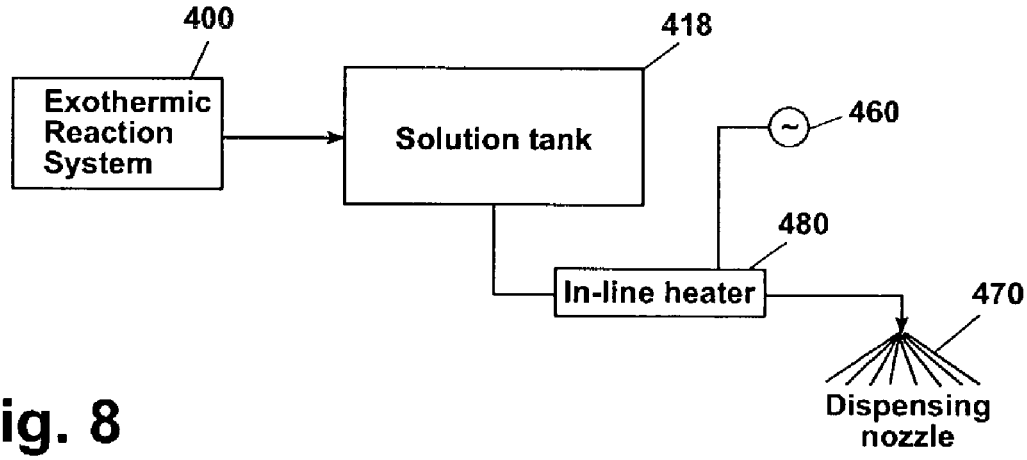
FIG. 8 is a schematic representation of an exothermic reaction heating process according to a fourth embodiment of the invention.

Referring now to FIG. 8, in a fourth embodiment of the invention, the exothermic reaction generated by the addition of exothermic heating system 400 to a cleaning solution within the solution tank 418 elevates the temperature of the cleaning solution. This elevated temperature may yet remain below the optimal temperature determined for the cleaning solution to be effective on a surface to be cleaned. The heating effect of the exothermic reaction is then supplemented by the injection of heat energy into the cleaning solution by an in-line heater 480, having an electrical power source 460, fluidly connected between the clean solution tank 418 and a dispensing nozzle 470 on the extraction cleaner.

Figure 9:
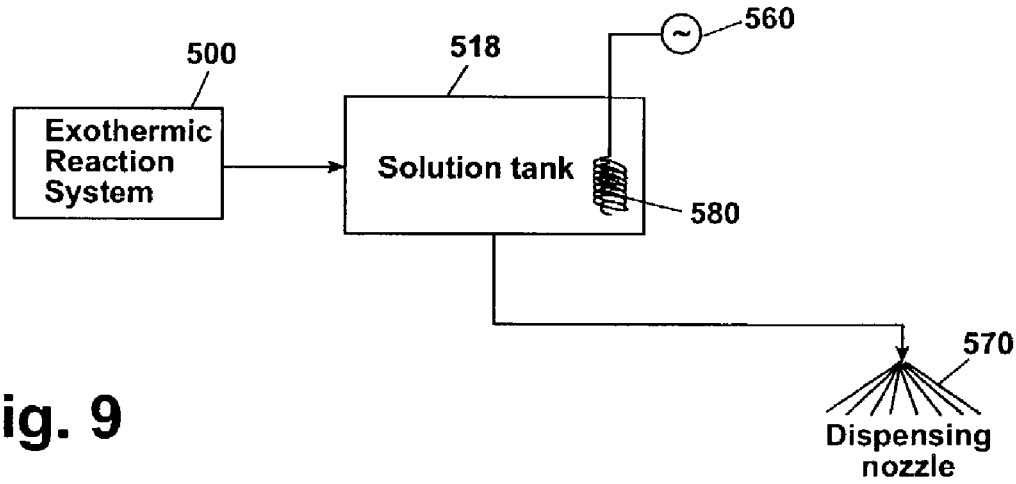
FIG. 9 is a schematic representation of an exothermic reaction heating process according to a fifth embodiment of the invention.

In a fifth embodiment of the invention shown in FIG. 9, the exothermic reaction generated by the addition of exothermic heating system 500 to a cleaning solution within the solution tank 518 elevates the temperature of the cleaning solution. The energy released by this exothermic reaction is supplemented by an in-tank heater 580, having electrical power source 560, positioned within the solution tank 518 to elevate the temperature of the cleaning solution to an optimal temperature for effectiveness of the cleaning solution on the surface to be cleaned.

Figure 10:
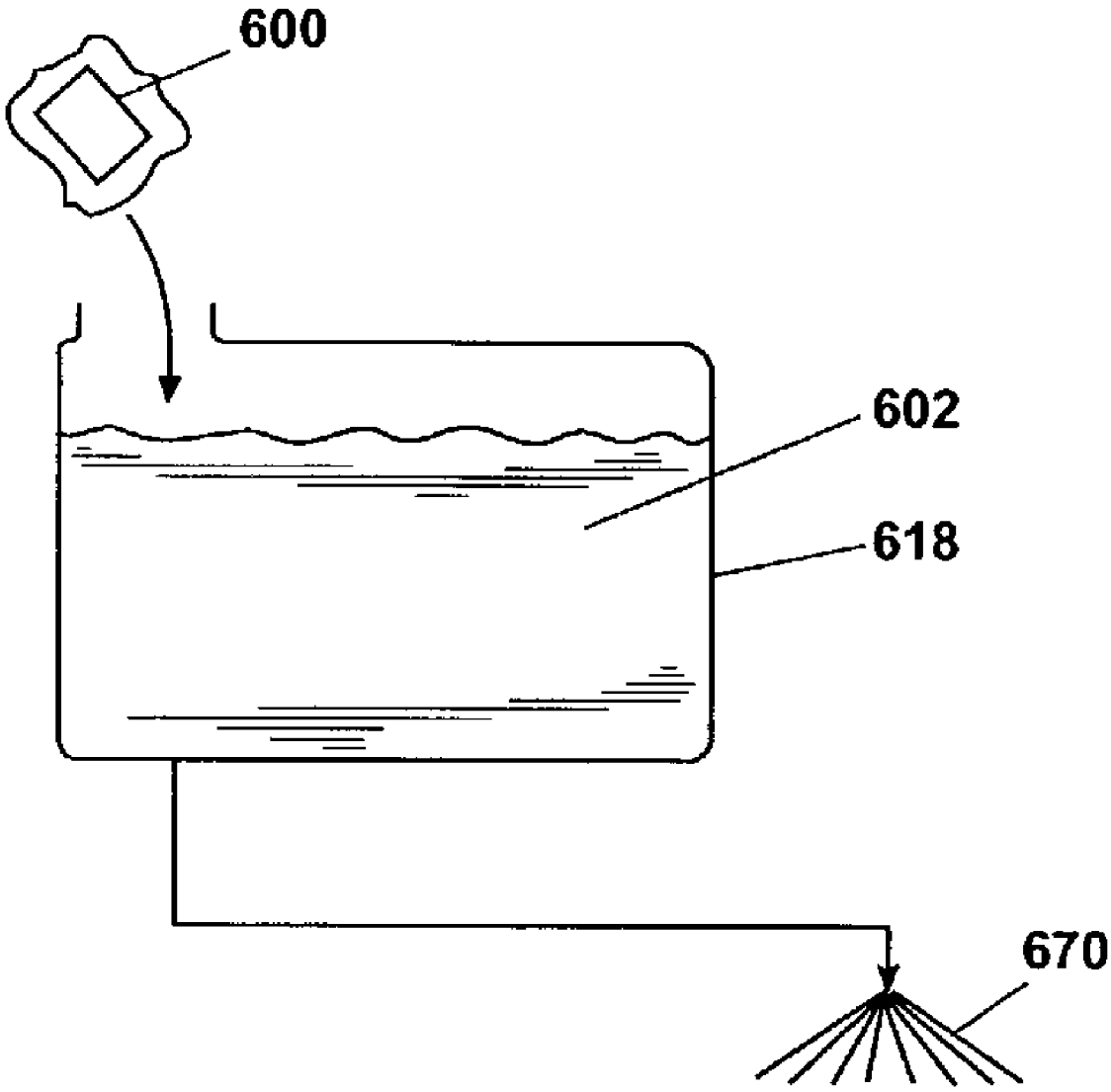
FIG. 10 is a schematic representation of an exothermic reaction heating process according to a sixth embodiment of the invention.

Referring to FIG. 10, in a sixth embodiment of the invention, the exothermic heating system 600 comprises a supercorroding metallic alloy powder dispersed throughout a porous polyethylene matrix and contained by a porous envelope, for reaction with an appropriate electrolytic solution. An example of this system is disclosed in U.S. Pat. No. 4,522,190, which is incorporated herein by reference. In FIG. 10, the system 600 is immersed in the cleaning solution 602. The cleaning solution 602 penetrates the porous envelope to react with the system 600. It is anticipated that the system 600 can be placed in the cleaning solution 602 in the solution tank 618 shortly before dispensing the cleaning solution 602 through a dispensing nozzle 670.

The invention has been illustrated with respect to a particular upright extraction cleaning machine. The invention is applicable to all types of extraction cleaning machines, including commercial cleaning machines as well as domestic cleaning machines, canister extractors, hand held portable extractors.

While the invention has been specifically described in connection with certain specific embodiments thereof, it is to be understood that this is by way of illustration and not of limitation. Reasonable variation and modification are possible within the forgoing description and drawings without departing from the spirit of the invention, which is embodied in the appended claims.

The invention claimed is:

1. A method of cleaning a surface comprising the steps of heating a cleaning solution with an exothermic chemical reaction, applying the heated cleaning solution to the surface to clean the surface and recovering soiled cleaning solution from the surface, wherein the exothermic chemical reaction comprises a phase change in a compound or composition that generates heat when transforming from a liquid phase to a solid phase.

2. A method of cleaning a surface according to claim 1 wherein the liquid phase is a sodium acetate solution.

3. A method of cleaning a surface according to claim 1 wherein the exothermic reaction is activated by introducing a metal into a liquid.

4. A method of cleaning a surface according to claim 2 wherein the exothermic reaction is activated by introducing an aluminum metal or alloy into the sodium acetate solution.

5. A method of cleaning a surface comprising the steps of heating a cleaning solution with an exothermic chemical reaction, applying the heated cleaning solution to the surface to clean the surface and recovering soiled cleaning solution from the surface, wherein the exothermic chemical reaction comprises a phase change in a compound or composition that generates heat when transforming from one solid phase to another solid phase.

6. A method of cleaning a surface comprising the steps of heating a cleaning solution with an exothermic chemical reaction, applying the heated cleaning solution to the surface to clean the surface and recovering soiled cleaning solution from the surface, wherein the exothermic chemical reaction comprises the step of combining two or more reagents that, when combined, undergo an exothermic reaction, wherein the two or more reagents are aluminum and a reactant caustic compound.

7. A method of cleaning a surface comprising the steps of heating a cleaning solution with an exothermic chemical reaction, applying the heated cleaning solution to the surface to clean the surface and recovering soiled cleaning solution from the surface, wherein the exothermic chemical reaction comprises the step of combining two or more reagents that, when combined, undergo an exothermic reaction, wherein the two or more reagents include a supercorroding metal alloy.

* * * * *